US008845443B1

(12) United States Patent
Weaver

(10) Patent No.: US 8,845,443 B1
(45) Date of Patent: Sep. 30, 2014

(54) SYSTEM AND METHOD OF FORMING A GOLF COURSE SAND BUNKER HAVING IMPROVED STABILITY

(71) Applicant: Sean Somers Weaver, Redding, CA (US)

(72) Inventor: Sean Somers Weaver, Redding, CA (US)

( * ) Notice: Subject to any disclaimer, the term of this patent is extended or adjusted under 35 U.S.C. 154(b) by 54 days.

(21) Appl. No.: 13/772,269

(22) Filed: Feb. 20, 2013

Related U.S. Application Data

(60) Provisional application No. 61/601,018, filed on Feb. 20, 2012.

(51) Int. Cl.
*A63B 57/00* (2006.01)
*E01C 13/06* (2006.01)
*A63B 69/36* (2006.01)

(52) U.S. Cl.
CPC ..... *E01C 13/065* (2013.01); *A63B 57/0068* (2013.01); *A63B 69/3691* (2013.01)
USPC ..... 473/173; 405/302.6

(58) Field of Classification Search
USPC ..... 473/168, 169, 173; 405/302.4–302.7
See application file for complete search history.

(56) References Cited

U.S. PATENT DOCUMENTS

| | | | | |
|---|---|---|---|---|
| 5,147,156 | A * | 9/1992 | Guettler et al. | 406/197 |
| 5,746,546 | A * | 5/1998 | Hubbs et al. | 405/263 |
| 7,207,747 | B1 * | 4/2007 | England | 405/43 |
| 7,344,340 | B2 * | 3/2008 | Carlson et al. | 405/302.6 |
| 7,399,145 | B2 * | 7/2008 | Clark | 405/302.7 |
| 7,413,380 | B2 * | 8/2008 | Corwon et al. | 405/37 |
| 7,699,562 | B2 * | 4/2010 | Clark | 405/129.75 |
| 8,062,143 | B1 * | 11/2011 | Meersman | 473/173 |
| 8,529,159 | B2 * | 9/2013 | Lemons | 405/302.6 |
| 2003/0177799 | A1 * | 9/2003 | Park et al. | 71/903 |
| 2004/0156679 | A1 * | 8/2004 | Jenkins et al. | 404/76 |
| 2007/0237583 | A1 * | 10/2007 | Corwon et al. | 405/37 |
| 2013/0116060 | A1 * | 5/2013 | Allen | 473/173 |
| 2013/0184090 | A1 * | 7/2013 | Sternberg | 473/173 |

FOREIGN PATENT DOCUMENTS

| | | | | |
|---|---|---|---|---|
| GB | 2035098 A | * | 6/1980 | E02D 17/20 |

* cited by examiner

*Primary Examiner* — Mark Graham

(57) ABSTRACT

A golf course sand bunker comprising a soil layer, a base layer of playing sand covering at least 40% of the exposed area of the soil layer, a liquid-applied MDI urethane having a pre-cured viscosity within a selected range, a top layer of playing sand, and wherein the base layer of playing sand is adhered to the soil layer with the MDI urethane composition.

23 Claims, 2 Drawing Sheets

SYSTEM AND METHOD OF FORMING A GOLF COURSE SAND BUNKER HAVING IMPROVED STABILITY

RELATED APPLICATIONS

This application claims the benefit of priority to commonly-owned and U.S. Provisional Patent Applications No. 61/601,018, filed on Feb. 20, 2012, No. 61/619,430, filed on Apr. 3, 2012, and No. 61/700,338, filed on Sep. 13, 2012. All of the above-identified patent applications are herein incorporated by reference

FIELD OF THE INVENTION

The present invention relates generally to "sand traps" or golf course sand bunkers, and more particularly to a system and method for preventing the destabilization, erosion, and contamination of golf course sand bunkers.

BACKGROUND OF THE INVENTION

Golf course sand bunkers are typically formed by filling a hole or pit in the ground with light colored playing sand to a depth of 3 to 5 inches. Over time however the underlying soil that is sometimes dark in color or contains small rocks and other unwanted particles mixes with the playing sand and creates an unsightly surface. Additionally, rainwater causes erosion of the underlying soil and deformation of the sand bunker, leaching of dirt into the light colored sand, and instability of the walls, all of which are undesirable in a golf course sand bunker.

The prior art consists of several ways to address this unwanted erosion and instability, but the systems thus far developed have been costly, labor intensive to apply, and complex. In U.S. Pat. No. 5,746,546, Hubbs et. al. describe a soil stabilization system comprising a subgrade barrier that absorbs water that is designed to prevent moisture build-up in a golf course sand bunker. The system comprises a layer of particulate aggregate, fiber strands, and a series of water-activated adhesive particles that swell when water is absorbed in order to provide a path for moisture egress. This system is complicated and expensive due to the variety of components including specialized fibers, water absorbent adhesives, and the requirement to carefully place a layer of aggregate stone underneath the playing sand of the golf course sand bunkers. The complexity and expense of this system, combined with its sensitivity to damage during use makes this an undesirable solution to the problem to overcome the erosion and degradation of golf course sand bunkers.

In U.S. Pat. No. 8,062,143, Meersman describes a sand bunker having multiple porous layers consisting of a matrix of aggregate stone built up in successive layers of decreasing particle sizes and having "numerous voids" between the pieces of aggregate. However, this system fails to provide any erosion protection for steep walled bunkers owing to the difficulty of placing multiple layers of aggregate along steep walls often present in sand bunkers of the world's finest golf courses. Further disadvantages of this system are the excess labor and materials needed to form such a system, which often includes digging a very deep bunker as a starting point to allow room for the multiple layers aggregate. A further safety concern is created by this system which intentionally includes aggregate particles underlying the playing sand, which risks being contacting by golf clubs during play and can damage golf club heads and lead to dangerous flying particles of aggregate stone.

In US Pat. App. No. 2011/0111216, Bowers describes an article comprising Portland cement mixed with colloidal silica that is substantially free of alkali metal to form a non-thixotropic coating, employed to improve the durability of paving systems. However, this system fails to provide a rigid base structure that can be successfully employed in a golf course sand bunker and merely attempts to seal a rigid article with an expensive top layer that fails to provide necessary strength and flexibility to the underlying layer.

Therefore a need exists in the art for a durable, inexpensive system and method for improving the erosion resistance and durability of golf course sand bunkers.

SUMMARY OF THE INVENTION

One embodiment of the invention provides a golf course sand bunker comprising an under layer of soil, a base layer of playing sand comprising MDI urethane, and a top layer of playing sand over the base layer, wherein the base layer is adhered to the under layer with the MDI urethane composition. In some embodiments, the MDI urethane comprises a mixture of natural soy polyols. In further embodiments, the MDI urethane comprises one or more plasticizers that advantageously increase the penetration depth of the MDI urethane when applying over the base layer of playing sand.

Another embodiment of the invention provides a method of treating a golf course sand bunker which includes providing a golf course sand bunker which is substantially devoid of playing sand, adding a base layer playing sand to a depth of 1 cm to 3 cm and covering at least 40% of the exposed surface area of the soil, applying an MDI urethane composition over the base layer in an amount sufficient to adhere the base layer to the underlying soil layer, allowing the urethane mixture to partially cure or fully cure, and applying a top layer of playing sand over the base layer of playing sand to a depth of 7 cm to 15 cm. In certain embodiments the playing sand of the base layer is pre-mixed with MDI urethane prior to application of the base layer of playing sand to the underlying soil layer.

DESCRIPTION OF THE PREFERRED EMBODIMENTS

One embodiment of this invention provides a method of forming a golf course sand bunker article to provide improved resistance to erosion and other stressors such as thermal cycling, rain, and occasional impact from golf clubs during play. Exemplary embodiments include a sand bunker with a base layer of sand comprising an MDI urethane, wherein the base layer covers more than 70% of the under layer of soil and is adhered to the soil with MDI urethane, and further comprising a top layer of playing sand over the base layer of playing sand. In some embodiments, where the walls of the bunker have an incline of greater than 60 degrees from horizontal, an aliphatic urethane is used to adhere the base layer of playing sand to the bunker walls.

Figure 1:
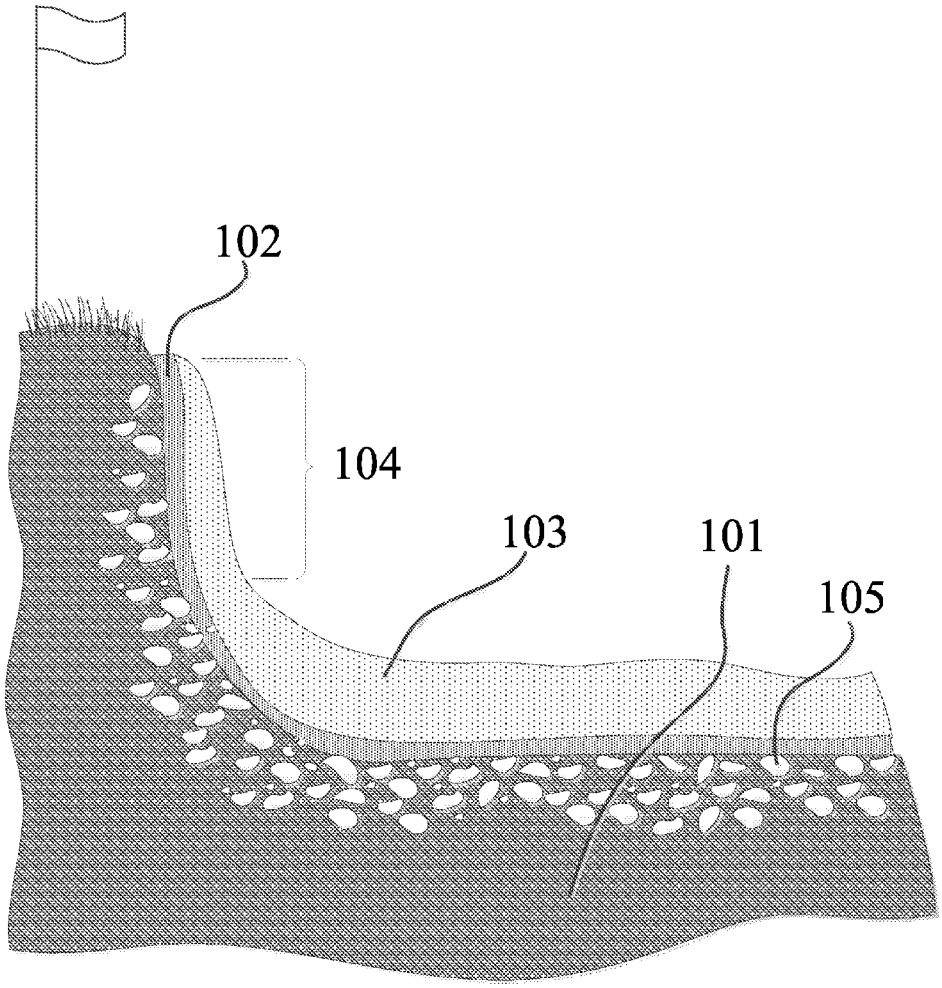
FIG. 1 is a cross-sectional side view of a golf course sand bunker having a novel layer according to one embodiment of the invention.
Figure 2:
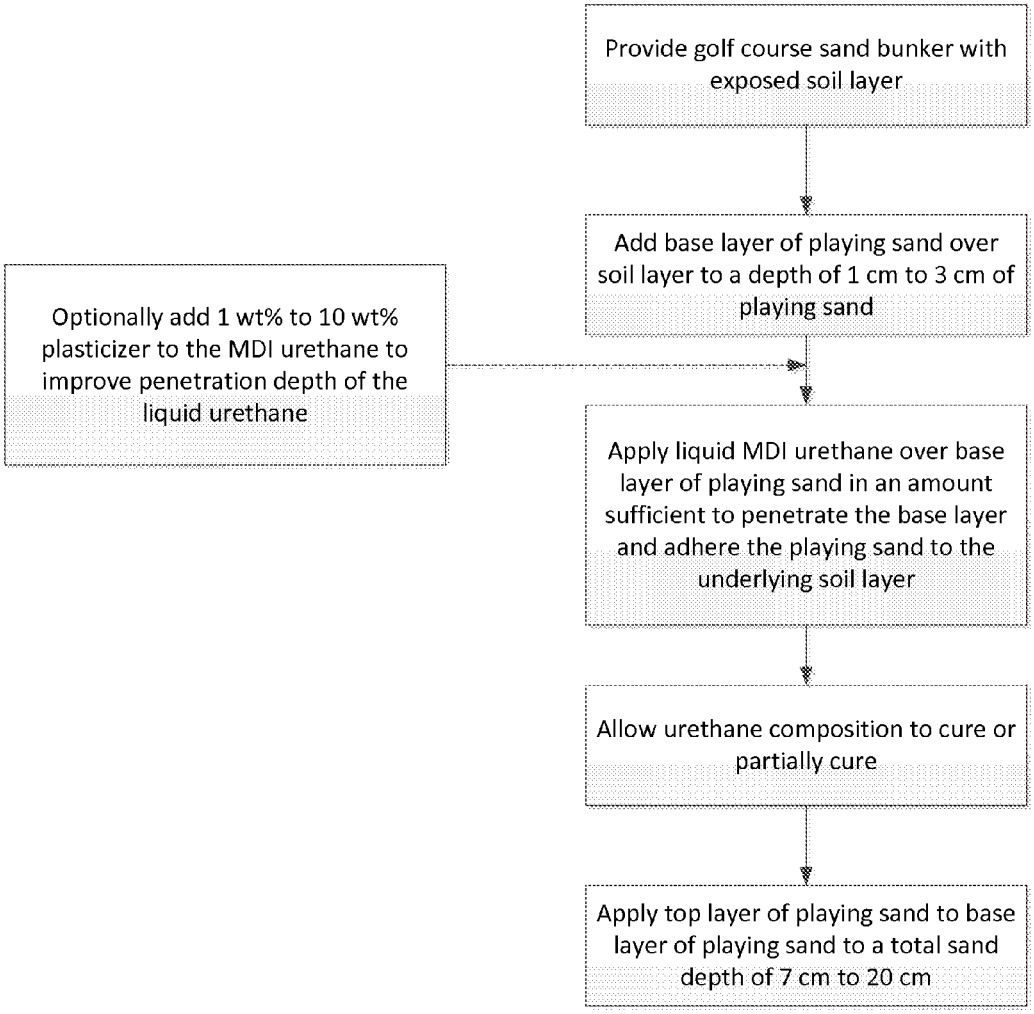
FIG. 2 is a flow diagram for a method of forming a golf course sand bunker according to one embodiment of the invention.

FIG. 1 depicts a golf course sand bunker according to one embodiment of the invention. Under layer 101 is comprised of soil or other filler materials commonly used in golf course construction. Particles 105 may be rocks or other unwanted particles mixed with the soil layer that could cause harm to the golfer or golf club if inadvertently contacted when a golf club swings through the playing sand. Base layer 102 is comprised of playing sand that is applied over soil layer 101 to a depth of approximately 1 cm to 3 cm in one embodiment. Preferably the sand layer covers at least 40% of the exposed surface area of under layer 101, more preferably at least 70%, and even more preferably covers at least 80% of the exposed area. After the base layer 102 is applied, a liquid MDI urethane coating is sprayed, poured, or otherwise applied to the base layer in an amount sufficient to penetrate through the base layer of playing sand and adhere base layer 102 to underlying soil layer 101.

Certain regions of the sand bunker may have steep walls, such as region 104 shown in FIG. 1. These steep regions often create a more challenging surface to apply base layer 102 to under layer 101, and the inventors have found that a pre-mix of sand and liquid urethane may be formed separately and then applied to the walls of the sand bunker using a shovel, trowel or other tools known in the art for applying paste-like materials. This method advantageously allows very steep walls to be coated with a protective base layer of sand, even vertical or near-vertical walls. In some embodiments, the less expensive MDI urethane compositions are replaced with more costly aliphatic urethane compositions for use on steep wall regions. The inventors have found that vertical walls may lose their protective top layer of playing sand which exposes the base layer to UV light from the sun. For this reason, some embodiments of the present invention employ a pre-mix of aliphatic urethane with sand which is then applied to the steep wall sections of the bunker.

After the urethane in base layer 102 has been cured or partially cured, a top layer of playing sand 103 is added over the base layer to completely cover any exposed areas of soil and to provide a depth of playing sand for use during regular golf play. The depth of playing sand in this top layer is typically between 7 cm and 15 cm for optimal performance with reasonable cost.

To make the sand bunker treatment process more convenient, the MDI and aliphatic urethanes are preferably formulated with an extended curing time of at least 10 hours, or more preferably at least 18 hours, and even more preferably of at least 24 hours in order to allow sufficient time for a full workday to be completed with sufficient time remaining to clean and remove the urethane residue from any tools used during application and or from the mixing equipment before the urethane compositions are cured. In one embodiment, the MDI urethane of the present invention comprises between 24 wt % and 34 wt % NCO, is formulated to achieve a viscosity of 300 SSU at a temperature of 78 degrees Fahrenheit, and has a density of 10.1 pounds per gallon.

In some embodiments, a catalyst is be employed in relatively low amounts to extend the curing time, such as for example 1 wt % to 5 wt % catalyst. Typical catalysts include organometallic compounds and tertiary amines, and mixtures thereof. For example, N-methyl morpholine, bismuth carboxylates, triethylenediamine, lead octoate, ferric acetylacetonate, stannous octoate, dimethyltin dilaurate, dibutylin dilaurate, dibutyltin sulfide, have been found to favorably operate on the MDI urethanes of the present invention. A catalyst may be used to increase the rate of curing of the urethane compound, where an organometallic catalyst may be added to in a range from about 0.05 to 0.8 weight percent within the urethane prepolymer. Additionally, if a tertiary amine catalyst is employed it may be added in a range from about 0.1 to 4 weight percent to the urethane prepolymer in exemplary embodiments of the present invention.

Curing time of the urethane mixture is preferably greater than 4 hours, more preferably greater than 8 hours, and even more preferably greater than 16 hours, for example 20 to 30 hours. By formulating the MDI urethane mixture to have an extended curing time, for example by reducing the quantity of catalyst present in the pre-polymer mix, the inventors have found that the application of the urethane is more convenient and allows for more time to clean up the tools and equipment following treatment of a sand bunker.

Optionally, one or more natural oil polyols (NOP) additives are mixed with the MDI urethane composition to lower the viscosity improve the ability of the urethane to disperse within the sand. Examples of suitable natural oil polyols include polyols derived from soy bean oil, peanut oil, and canola oil. Soy bean oil is a preferred polyol feed stock due to its low environmental impact, availability, and cost. However, the inventors have found that the performance of soy polyol in the MDI urethane of the present invention is improved by hydroxylating a portion of the soy polyol prior to mixing with MDI urethane. Example processes for hydroxylation include ozonolysis, air oxidation, autooxidation, and reaction with peroxy acids followed by reaction with nucleophiles to form hydroxyl groups on the soy polyols. Hydroxylating the soy polyol allows it to react with the MDI urethane to provide increase strength and flexibility to the golf course sand bunkers of the present invention, while the remaining, unreacted soy polyols acts as a plasticizer. In one embodiment, approximately 3-5 weight percent soy polyols is added to the MDI urethane of the present invention. In other embodiments, 10-30 weight percent hydroxylated soy polyol, such as 15 weight percent, such as 20 weight percent, or such as 25 weight percent hydroxylated soy polyols is added to the MDI urethane of the present invention.

In other embodiments, one or more chain extenders area added to the MDI urethane to modify the flexibility and strength of the base layer of playing sand in the golf course sand bunkers of the present invention. Examples include low molecular weight hydroxyl compounds, ethylene glycol, and butane diol in preferred embodiments. Additionally, chain extenders may be used to speed up the reaction time as desired, for example in cold environments where the curing time may be depressed due to reduced temperatures. Preferred chain extenders include polyolamines, which react quickly with the isocyanate function groups in the aqueous phase. Examples include amine terminated polyether such as 2-methyl piperazine, bis(aminomethyl)cyclohexane and isomers, 1,5-diamino-3-methyl-pentane, amino ethyl piperazine ethylene diamine, diethylene triamine, aminoethyl ethanolamine, triethylene tetraamine, isophorone diamine, triethylene pentaamine, ethanol amine, lysine in any of its stereoisomeric forms and salts thereof, hexane diamine, hydrazine and piperazine.

In some embodiments, one or more surfactants are added to the MDI urethane to reduce foaming and improve the density of the cured urethane article, thereby improve the long term durability of the golf course sand bunker system. Suitable foam stabilizing surfactants include sulfates, sulfosuccinamates, and succinamates, and other foam stabilizers known to be useful by those of skill in the art. In other embodiments, the inventors have found that surfactants such as high molecular weight silicone surfactants having a number average molecular weight in excess of 9,000 will improve the wetting ability of the urethane and increase the surface contact area of MDI urethane on the aggregate. Examples surfactants may be found in U.S. Pat. No. 5,489,617, which is incorporated herein by reference in its entirety. Relevant sections may be found in col. 3-4 of the aforementioned disclosure. Other suitable surfactants that may be employed to advantageously increase the wetting ability of the MDI urethane to the playing sand include cationic surfactants, anionic surfactants, zwitterionic surfactants, and non-ionic surfactants. Examples of anionic surfactants include phosphates, carboxylates, and sulfonates. Examples of cationic surfactants include quaternary amines, and example non-ionic surfactants include silicone oils and block copolymers containing ethylene oxide. Suitable surfactants may be either external surfactants, which do not become chemically reacted into the polymer such as dodecyl benzene sulfonic acid and lauryl sulfonic acid salts, as well as internal surfactants such as 2,2-dimethylol propionic acid and its salts, quaternized ammonium salts, and hydrophilic species such as polyethylene oxide polyols.

In another embodiment of the invention, MDI urethane compositions with reduced viscosity are employed in order to increase the penetration depth into the playing sand of the thin base layer of the sand bunker. In certain embodiments, the urethane viscosity is less than about 4,000 SSU (1,000 centipoise), more preferably is less than about 1,500 SSU (300 centipoise), and even more preferably is less than about 200 SSU (40 centipoise), for example, 100 SSU (20 centipoise) when measured at 78 degrees Fahrenheit. The inventors have found that reducing the urethane viscosity improves the penetration depth into the playing sand and allows the urethane to penetrate, in certain instances, all the way to the under layer of soil beneath the base layer to create a bond between the base layer of sand and the under layer of soil. This increased penetration and soil-sand bond creates a durable barrier to prevent erosion of the under lying soil.

Optionally, the urethane compositions of the present invention may include dispersants, reinforcing fibers, pigments, acid scavengers, antistatic agents, or antioxidants. In a preferred embodiment, a plasticizer is added to the urethane to improve the wetting ability of the urethane mixture to the sand. For example, between 1 wt % and 10 wt % plasticizer may be added to the urethane compositions of the present invention. Suitable plasticizers include diisodecyl phthalate, di-n-octyl phthalate, diisobutyl phthalate, diisononyl phthalate, bis(2-ethylhexyl) phthalate, diethyl phthalate, and bis(n-butyl)phthalate.

The inventors have also found that biodegradable plasticizers are particularly advantageous for use in sand bunkers of the present invention owing to their improved compatibility with the environment and the desire for golf course owners to minimize their environmental impact. Suitable biodegradable plasticizers include triethyl citrate, acetyl triethyl citrate, tributyl citrate, acetyl tributyl citrate, trioctyl citrate, acetyl trioctyl citrate, acetyl trihexyl citrate, trimethyl citrate, and alkyl sulphonic acid phenyl ester.

It is to be understood that the present invention is not limited to the embodiment(s) and the example(s) described above and illustrated herein, but encompasses any and all variations falling within the scope of the appended claims. For example, as is apparent from the claims and specification, not all method steps need be performed in the exact order illustrated or claimed, but rather in any order that allows the proper formation of the solar cells of the present invention.

What is claimed is:

1. A golf course sand bunker, comprising:
an under layer comprising soil;
a base layer of playing sand;
a top layer of playing sand;
a selected amount of urethane having a pre-cured viscosity within a selected range; and
wherein the base layer of playing sand is adhered to the under layer with a urethane composition having a curing time of greater than 8 hours.

2. The golf course sand bunker of claim 1, wherein the urethane has a curing time of between 20 hours and 40 hours.

3. The golf course sand bunker of claim 1, wherein the urethane further comprises between 1 wt % to 10 wt % plasticizer.

4. The golf course sand bunker of claim 1, wherein the urethane is MDI urethane having a pre-cured viscosity of between 100 SSU and 1,000 SSU.

5. The golf course sand bunker of claim 3, wherein the plasticizer is selected from the group consisting of diisodecyl phthalate, di-n-octyl phthalate, diisobutyl phthalate, diisononyl phthalate, bis(2-ethylhexyl) phthalate, diethyl phthalate, and bis(n-butyl)phthalate.

6. The golf course sand bunker 3, wherein the plasticizer is biodegradable and is selected from the group consisting of triethyl citrate, acetyl triethyl citrate, tributyl citrate, acetyl tributyl citrate, trioctyl citrate, acetyl trioctyl citrate, acetyl trihexyl citrate, trimethyl citrate, and alkyl sulphonic acid phenyl ester.

7. The golf course sand bunker of claim 1, wherein the under layer comprises compacted soil having at least one wall with an incline of greater than 60 degrees from horizontal.

8. The golf course sand bunker of claim 1, wherein the base layer comprises playing sand having an average particle size of between two and five times larger than the average particle size of the playing sand of the top layer of playing sand.

9. The golf course sand bunker of claim 1, wherein the urethane contains between 0.05 and 8 weight percent surfactant selected from the group comprising quaternary amines, block copolymers containing ethylene oxide, silicone oils, dodecyl benzene sulfonic acid, lauryl sulfonic acid, 2,2-dimethylol propionic acid, and polyethylene oxide polyols.

10. The golf course sand bunker of claim 2, wherein the urethane consists of MDI urethane.

11. The golf course sand bunker of claim 1, wherein the base layer of sand covers at least 80% of the exposed surface area of the under layer of soil.

12. A golf course sand bunker stabilization system comprising:
an under layer comprising soil;
a base layer of playing sand;
a top layer of playing sand;
a selected amount of MDI urethane having a pre-cured viscosity within a selected range; and
wherein the base layer of playing sand is adhered to the under layer with MDI urethane having a curing time of greater than 20 hours.

13. The golf course sand bunker of claim 12, wherein the MDI urethane has a curing time of between 30 hours and 50 hours.

14. The golf course sand bunker of claim 2, wherein the base layer of playing sand is between 1 cm and 7 cm thick.

15. The golf course sand bunker of claim 12, wherein the surface layer of playing sand has a thickness between 5 centimeters 20 centimeters.

16. The golf course sand bunker of claim 12, wherein the under layer comprises compacted soil having at least one wall with an incline of greater than 80 degrees from horizontal.

17. A method of treating a golf course sand bunker comprising the steps:
providing a golf course sand bunker comprising a base layer of soil which is substantially devoid of playing sand;

adding a base layer of playing sand over the soil to cover at least 70% of the exposed surface area of the soil;

spaying an MDI urethane liquid over the base layer of playing sand;

adding a top layer of playing sand over the base layer of playing sand to substantially cover the base layer of playing sand and cover the remaining exposed surface area of the base layer of soil.

18. The method of claim 17, further comprising:

pre-mixing an aliphatic urethane with playing sand and applying the mixture to the walls of the bunker that have an incline of greater than 70 degrees from horizontal.

19. The method of claim 17, further comprising:

pre-mixing an MDI urethane with playing sand and applying the mixture to the walls of the bunker that have an incline of greater than 70 degrees from horizontal.

20. The method of claim 17, wherein:

the MDI urethane comprising between 1 wt % and 10 wt % plasticizer selected from the group consisting of diisodecyl phthalate, di-n-octyl phthalate, diisobutyl phthalate, diisononyl phthalate, bis(2-ethylhexyl)phthalate, diethyl phthalate, and bis(n-butyl)phthalate.

21. The method of claim 17, wherein:

the MDI urethane comprising between 1 wt % and 10 wt % plasticizer selected from the group consisting of diisodecyl phthalate, di-n-octyl phthalate, diisobutyl phthalate, diisononyl phthalate, bis(2-ethylhexyl) phthalate, diethyl phthalate, and bis(n-butyl)phthalate.

22. The method of claim 17, wherein:

the MDI urethane comprising between 1 wt % and 10 wt % plasticizer selected from the group consisting of triethyl citrate, acetyl triethyl citrate, tributyl citrate, acetyl tributyl citrate, trioctyl citrate, acetyl trioctyl citrate, acetyl trihexyl citrate, trimethyl citrate, and alkyl sulphonic acid phenyl ester.

23. The method of claim 17, wherein:

The urethane has a curing time of between 20 hours and 40 hours.

* * * * *